US005967147A

United States Patent [19]

Newman

[11] Patent Number: 5,967,147

[45] Date of Patent: Oct. 19, 1999

[54] WATER PIPE BOWL STEM VALVE APPARATUS AND METHOD

[76] Inventor: Mark R. Newman, P.O. Box 17009, Tucson, Ariz. 85731

[21] Appl. No.: 08/891,844

[22] Filed: Jul. 21, 1998

[51] Int. Cl.[6] ..... A24F 1/26; A24F 15/00; A24F 23/04; A24F 1/02

[52] U.S. Cl. ..... 131/173; 131/180; 131/215.1

[58] Field of Search ..... 131/173, 215.1, 131/180; D27/166, 169; 429/76; 251/12; 137/409, 410

[56] References Cited

U.S. PATENT DOCUMENTS

| | | | |
|---|---|---|---|
| 586,149 | 7/1897 | Turner | 131/173 |
| 3,872,872 | 3/1975 | Kahler | 131/173 |
| 3,881,499 | 5/1975 | McFadden et al. | 131/171 |
| 3,918,464 | 11/1975 | Kolodziej | 131/173 |
| 4,014,353 | 3/1977 | Kahler | 131/173 |
| 4,029,109 | 6/1977 | Kahler | 131/173 |
| 4,031,905 | 6/1977 | Dunn | 131/173 |
| 4,071,035 | 1/1978 | Boyd et al. | 131/173 |
| 4,134,410 | 1/1979 | Kahler | 131/173 |
| 4,148,327 | 4/1979 | Graham | 131/173 |
| 4,165,753 | 8/1979 | Stryker | 131/173 |
| 4,170,237 | 10/1979 | Epstein | 131/173 |
| 4,244,383 | 1/1981 | Kahler | 131/180 |
| 4,253,475 | 3/1981 | Schreiber et al. | 131/173 |
| 4,257,432 | 3/1981 | Griffith et al. | 131/173 |
| 5,458,106 | 10/1995 | Kim | 131/173 |

*Primary Examiner*—Stanley S. Silverman
*Assistant Examiner*—Jacqueline A. Ruller
*Attorney, Agent, or Firm*—LaRiviere, Grubman & Payne, LLP

[57] ABSTRACT

A valved stem apparatus for use on a water pipe used for smoking. The valved stem is formed as an elongated hollow stem provided with a first open end, sized for mechanically interfacing with a pipe bowl assembly component of the water pipe, and with a second open end for being disposed within a liquid container member of the water pipe. The second open end is provided with a retaining structure that extends from the stem structure that delineates an opening at the second open end. A valve member, such as a ball valve, is disposed within the retaining structure such that it can freely travel within the retaining structure towards the opening portion of the second open end upon being submerged in a liquid. The opening portion is formed with a smooth beveled rim surface that conforms to the shape of the outer surface of the buoyant body to effect closure of the opening in a water-tight manner when not being forced open by a person drawing smoke from the mouthpiece. Once the drawing of smoke ceases, the buoyant force takes over to reclose the opening. The interior of the stem is essentially kept void of the liquid since the re-closure is virtually instantaneous. Any inadvertent tipping of the water pipe apparatus will not cause the buoyant body to be moved away from the opening of the hollow stem member and thus prevent any spillage of the liquid via the stem supporting the pipe bowl.

2 Claims, 2 Drawing Sheets

WATER PIPE BOWL STEM VALVE APPARATUS AND METHOD

TECHNICAL FIELD

The present invention relates to water pipes apparatus used for smoking. More particularly, the present invention relates to water pipe apparatus used for smoking and structural components used to prevent spillage of water from the apparatus. Even more particularly, the present invention relates to water spillage prevention apparatus and method used on the bowl-carrying stem portion of water pipe apparatus used for smoking.

BACKGROUND ART

A water pipe of the type used for smoking comprises an elongated cylindrical tube member which is typically filled with a liquid, such as water, to a level some arbitrary distance above the open, lower end portion of a hollow stem member that is attached to, or through a side wall of the cylindrical tube member of the water pipe apparatus. The hollow stem member provides support for the pipe bowl that is used to contain the smoking substance. The pipe bowl is itself typically an assembly comprising a short stem onto which the pipe bowl is attached at one end and sometimes the pipe structure detachably inserts into the outer open end of an additional hollow stem member. A holder for manipulating a hot pipe bowl is interdisposed between the pipe bowl and the upper end of the short stem. The hollow stem member attaches to the side wall of the cylindrical tube member at an angle that is less than 90 degrees and greater than zero degrees. The basic idea being to maintain the smoking substance within the pipe bowl while being used. The side wall of the elongated cylindrical tube, where the hollow stem member attaches, is provided with an entry port which may be fitted with a grommet sized to receive the body of the hollow stem member in a water-tight manner. The elongated cylindrical tube member is usually supported at the bottom end by a base member. The bottom end of the cylindrical tube typically inserts into a cavity provided on the base, and fits such that a water-tight fit is produced. The upper end of the elongated cylindrical tube is sometimes finished smooth or may be fitted with a removable mouthpiece that fits about the rim of the tube. The length of the elongated cylindrical tube determines basically the height of the water pipe apparatus, and may be six (6) inches to seventy-two inches (72) inches or more in height. Upon filling the elongated tube with a liquid, such as water, to a desired level above the open, lower end of the hollow stem member, the water level also extends into the hollow stem member. The higher the water level is in the elongated cylindrical tube, the higher the water level extends into the hollow stem member. The high level of the water in the hollow stem member sometimes results in the pipe bowl being highly susceptible to water being spilled into the pipe bowl by any inadvertent tipping of the upright water pipe structure. The spillage into the pipe bowl is a highly undesirable situation, as is any spillage of liquid out of the pipe bowl onto the floor.

To applicant's knowledge, the prior art does not teach the placement of any valving means to prevent the foregoing described spillage of liquid via the pipe bowl end of the water pipe apparatus. Accordingly, a need is seen to exist for a water pipe apparatus which is provided with a valving means for preventing the spillage of a liquid, such as water, through the pipe bowl attachment structure.

It is therefore a primary object of the present invention to provide a hollow stem apparatus for use on a water pipe structure for functionally supporting a pipe bowl and that is provided with a valving means for preventing the spillage of a liquid, such as water through the pipe bowl.

A related object of the present invention to provide water pipe smoking structure provided with a hollow stem apparatus that is used for functionally supporting a pipe bowl and that is provided with a valve means for preventing the spillage of water through the pipe bowl.

DISCLOSURE OF INVENTION

Accordingly, the foregoing objects are accomplished by providing a stem apparatus for use on a water pipe used for smoking. The stem apparatus comprises an elongated hollow stem member having a first open end sized for mechanically interfacing with a pipe bowl member of a water pipe and a second open end for being disposed within a liquid container member of the water pipe. The second open end of the stem member comprises a retaining structure extending from stem structure that delineates an opening portion of the second open end. A valve member, preferably a buoyant body such as a ball, is disposed within the retaining structure such that it can freely travel within the retaining structure towards the opening portion of the second open end upon being submerged in a liquid, such as water. The opening portion is formed with a smooth beveled rim surface such that it conforms to the shape and texture of the outer surface of the buoyant body to effect closure of the opening when not being forced open by a person drawing smoke from the mouthpiece. It should be understood that the closure is effected by the upward pressure of the submerged buoyant body and the buoyant force is such that the person drawing smoke from the mouthpiece can effectively overcome the upward buoyant force to pull the buoyant body from the opening to allow the flow of smoke from the pipe bowl, through the stem, and through the water towards the mouthpiece. Once the drawing of smoke ceases, the buoyant force takes over to reclose the opening. The interior of the stem is essentially kept void of the liquid since the reclosure is virtually instantaneous. Any inadvertent tipping of the water pipe apparatus will not cause the buoyant body to be moved away from the opening of the hollow stem member. The retaining structure, for a ball valve type of buoyant body, comprises a plurality of finger-like structure that surround the ball and that facilitate movement of the ball to effect the open and closed state of the ball valve.

Other features of the present invention are disclosed or apparent in the section entitled: "BEST MODE FOR CARRYING OUT THE INVENTION."

BRIEF DESCRIPTION OF DRAWINGS

For fuller understanding of the present invention, reference is made to the accompanying drawing in the following detailed description of the Best Mode of Carrying Out the Present Invention. In the drawings.

Figure 1:
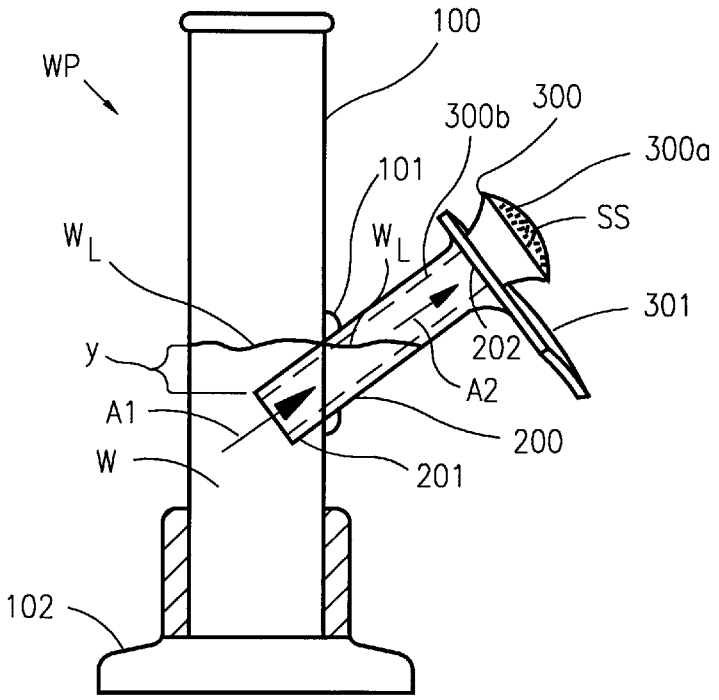
FIG. 1 (PRIOR ART)
FIG. 1 is a plan view of a water pipe apparatus showing the water level in the elongated tube member and in the bowl-carrying stem member through which water spillage is sought to be prevented by the present invention.

Reference numbers refer to the same or equivalent parts of the present invention throughout the several figures of the drawing.

BEST MODE FOR CARRYING OUT THE INVENTION

FIG. 1 shows, by example, a prior art water pipe apparatus WP having an elongated cylindrical tube member 100 filled with water W to a water level $W_L$ that reaches a variable distance y above an interior lower stem end portion 201 of stem member 200 of the water pipe apparatus WP. Typically, tube 100 is secured and disposed in a vertical, water-tight state by a base member 102. Stem member 200 typically attaches to tube 100 in a water-tight state through grommeted side entry port 101. Pipe bowl 300 comprises the bowl 300*a,* for carrying smoking substance SS, and a short stem portion 300*b* that detachably protrudes into exterior stem end portion 202. Pipe bowl holder 301 facilitates removal of pipe bowl 300 from within pipe bowl stem member 200, and is especially useful when the smoking substance is lit. In prior art, stems, such as stem 200, water W seeks a water level $W_L$ within stem 200, as indicated by arrow A1. As stated previously, water spillage occurs through stem 200 in the direction of arrow A2 upon inadvertent tipping of water pipe apparatus WP from a stable upright position.

Figure 2:
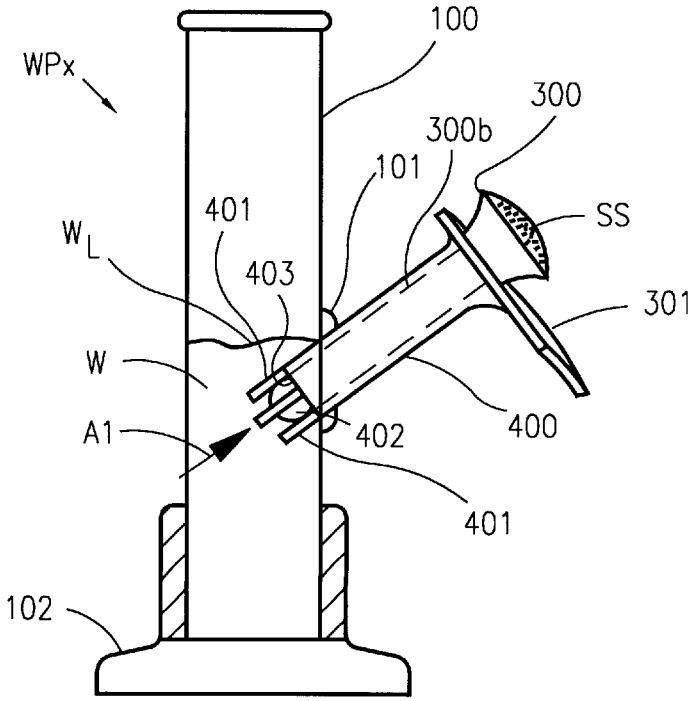
FIG. 2 is a plan view of a water pipe apparatus adapted with a stem having a valve member in accordance with the present invention to prevent water spillage through the pipe bowl stem member.

FIG. 2 shows a water pipe WPx adapted with a hollow stem member 400, in accordance with the present invention. Stem member 400 attaches to an elongated cylindrical tube member 100 in a water-tight state through grommeted side entry port 101, or other similar stem mounting techniques known in the industry. As depicted, the portion of stem member 400, that is external to tube member 100, functions in the manner as stem member 200, shown in FIG. 1, to carry a pipe bowl assembly 300. However, internal to tube member 100, stem member 400 comprises valve structure that differs from stem member 200 in that water W is prevented from entering the interior of stem 400. The valve structure of stem 400 comprises a retaining structure 401 that retains a ball valve member 402 such that it can freely travel within the retaining structure 401 towards the opening portion 403 of stem 400 to stop the flow of water into stem 400 upon being submerged in water. The closure of opening 403 is effected by the buoyancy force acting upon ball 402, as indicated by arrow A1. Opening portion 403 is formed with a smooth beveled rim surface that conforms to the shape of the outer surface of the buoyant body to effect closure of the opening in a water-tight manner when not being forced open by a person drawing smoke from the mouthpiece.

Figure 3:
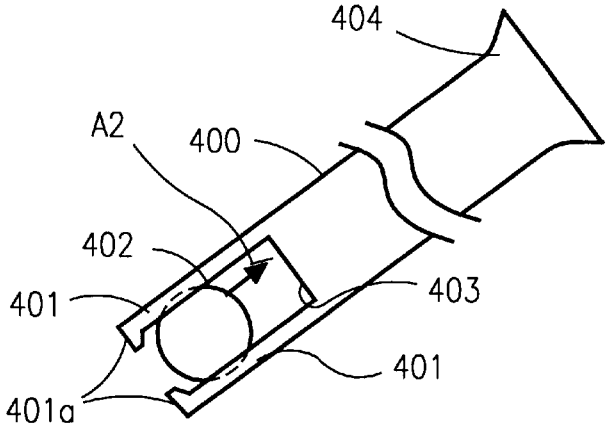
FIG. 3 is a side view of a stem having a valve member shown with the ball element in an open state in accordance with the present invention.
Figure 4:
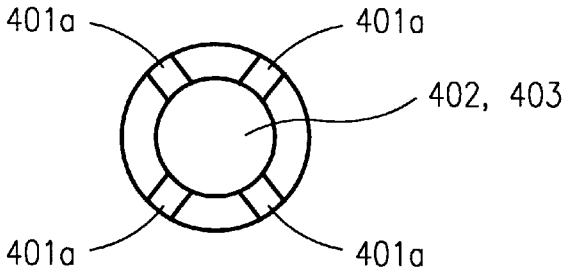
FIG. 4 is a bottom end view of the valved pipe bowl-carrying stem of the present invention showing the retaining finger structure used to retain the ball element stem member.
Figure 5:
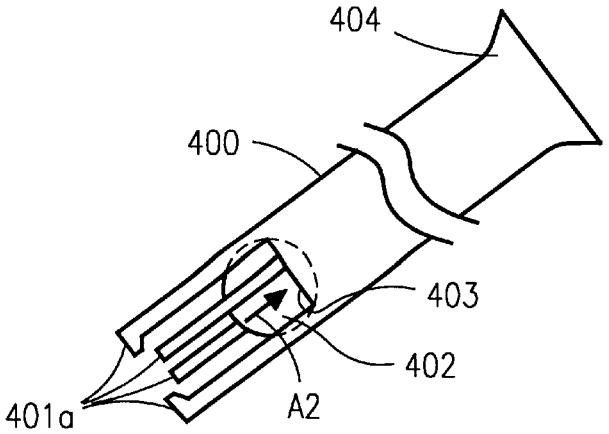
FIG. 5 is another side view of a stem having a valve member shown with the ball element in an closed state in accordance with the present invention.

FIG. 3 shows a fragmented stem member 400 where the ball valve member 402 is in an open state and is being held within retaining structure 401 by the inwardly bent tip portions 401*a* The open state may be due to gravity and the absence of liquid that would normally exert the buoyant force A2 that would urge the ball towards opening 403. In use, the open state is effected due to a person drawing smoke through stem 400 from a pipe bowl. Regardless, retaining structure 401 not only secures ball valve 402,but also allows back and forth movement to realize an open or closed state of opening 403. FIG. 3 also shows external end 404 of stem 400. End 404 is preferably outwardly flared to facilitate insertion of pipe bowl stem extension member 300*b* within stem 400. FIG. 4 shows a bottom end view of stem member 400 and retaining structure 401 and associated inwardly bent tip portions 401*a*. As best seen in FIG. 3, retaining structure 401 is formed as a plurality of finger-like members that extend from opening 403 and terminate as inwardly bent tip portions 401*a*. FIG. 5 shows another view of fragmented stem member 400 where ball valve member 402 is in a closed state, closing opening portion 403. Ball 402 is held in a water-tight manner about the opening 403 by buoyant force A2. The construction of ball 402 is lightweight buoyant plastic for facilitating a buoyant force in a liquid, such as water, to effect closure of opening 403.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims. The inventions illustratively disclosed herein may be practiced without any element which is not specifically disclosed herein.

I claim:

1. A stem apparatus for use on a water pipe used for smoking, said apparatus comprising:

an elongated hollow stem member, said hollow stem member having a first open end sized for mechanically interfacing with a pipe bowl member of said water pipe and a second open end for being disposed within a liquid container member of said water pipe; and a ball valve member operatively disposed at said second open end, wherein said second open end comprises a retaining structure extending from a stem structure delineating an opening portion of said second open end, wherein said ball valve member being operatively disposed within said retaining structure to facilitate a liquid pressure activated closed state, wherein said retaining structure comprises a plurality of finger shaped members extending outward from said stem structure towards a terminating end portion of each of said finger shaped members, each said terminating end portion having inwardly shaped tip portions that facilitate securing said ball valve member within a space delineated by said plurality of finger shaped members during an open and closed state effected by said ball valve member, and wherein said opening portion having a substantially smooth seat structure formed to conform with a surface of said ball valve member to facilitate a substantially water-tight seal during said closed state.

2. A water pipe apparatus used for smoking, said apparatus comprising:

a liquid container member, said liquid container member having a port for receiving pipe bowl assembly;

a pipe bowl assembly comprising a stem member for supporting and carrying a pipe bowl member and for interfacing with an interior of said liquid container member to facilitate smoke from a smoking substance being smoked to be filtered by a liquid contained in said liquid container member, said stem member comprising:

an elongated hollow stem member, said hollow stem member having a first open end sized for mechanically interfacing with said pipe bowl member and a second open end for being disposed within said liquid container member; and a ball valve member operatively disposed at said second open end, said valve member being functionally responsive to a buoyancy force produced by a liquid, wherein said second open end comprises a retaining structure extending from a stem structure delineating an opening portion of said second open end, wherein said valve member being operatively disposed within said retaining structure to facilitate a liquid pressure activated closed state, and wherein said retaining structure comprises a plurality of finger shaped members extending outward from said stem structure towards a terminating end portion of each of said finger shaped members, each said terminating end portion that facilitate securing said ball member within a space delineated by said plurality of finger shaped members during an open and closed state effected by said ball valve member, and wherein said opening portion having a substantially smooth seat structure formed to conform with a surface of said ball valve member to facilitate a substantially water-tight seal during said closed state.

* * * * *